US009161646B2

(12) United States Patent
Bertinotti

(10) Patent No.: US 9,161,646 B2
(45) Date of Patent: Oct. 20, 2015

(54) HOSIERY DONNING DEVICE, IN PARTICULAR FOR COMPRESSION HOSIERY

(76) Inventor: Silvia Bertinotti, Agrate Conturbia (IT)

( * ) Notice: Subject to any disclaimer, the term of this patent is extended or adjusted under 35 U.S.C. 154(b) by 940 days.

(21) Appl. No.: 12/521,559

(22) PCT Filed: Dec. 27, 2007

(86) PCT No.: PCT/IB2007/004106
§ 371 (c)(1),
(2), (4) Date: Nov. 8, 2010

(87) PCT Pub. No.: WO2008/081294
PCT Pub. Date: Jul. 10, 2008

(65) Prior Publication Data

US 2011/0049201 A1 Mar. 3, 2011

(30) Foreign Application Priority Data

Dec. 28, 2006 (IT) ..... VB2006A0012

(51) Int. Cl.
*A47G 25/90* (2006.01)

(52) U.S. Cl.
CPC ..... *A47G 25/905* (2013.01)

(58) Field of Classification Search
CPC ..... A47G 25/905; A47G 25/907
USPC ..... 223/111, 112, 118–119
See application file for complete search history.

(56) References Cited

U.S. PATENT DOCUMENTS

| | | | | |
|---|---|---|---|---|
| 1,374,544 | A * | 4/1921 | Asplund | 223/119 |
| 3,692,217 | A * | 9/1972 | Smith | 223/111 |
| 4,943,097 | A | 7/1990 | Sanger | |
| 5,419,283 | A * | 5/1995 | Leo | 119/709 |
| 6,056,171 | A * | 5/2000 | Santamaria | 223/112 |
| 6,241,134 | B1 | 6/2001 | Dunkel | |
| 6,942,129 | B2 * | 9/2005 | Ferraioli | 223/113 |

(Continued)

FOREIGN PATENT DOCUMENTS

| | | | | |
|---|---|---|---|---|
| FR | 2712162 | A1 * | 5/1995 | A47G 25/90 |
| FR | 2 814 930 | A1 | 4/2002 | |

(Continued)

OTHER PUBLICATIONS

PCT International Search Report for PCT Counterpart Application No, PCT/IB2007/004106, 4 pgs., (Jun. 13, 2008).

(Continued)

*Primary Examiner* — Shaun R Hurley
*Assistant Examiner* — Andrew Sutton
(74) *Attorney, Agent, or Firm* — Blakely Sokoloff Taylor & Zafman LLP

(57) ABSTRACT

A hosiery donning device, in particular for compression hosiery, has a support, a front end portion of which is inserted into the hosiery to be donned; the support defines a downwardly-facing cavity so that a foot can be inserted into the sock or stocking by making the support slide over the upper surface and instep of the foot; a handle is joined to the rear of the support, it is fixed and faces upwards in relation to the support; the cavity is defined by a saddle-shaped portion, on which at least a portion of the hosiery is gathered; the saddle-shaped portion accompanies a portion of the hosiery over the heel of the foot, when the handle is tilted forwards while the saddle-shaped portion remains in contact with the instep of the foot.

15 Claims, 4 Drawing Sheets

(56) References Cited

U.S. PATENT DOCUMENTS

| | | | | |
|---|---|---|---|---|
| 2006/0025712 | A1* | 2/2006 | Kammerer | 602/65 |
| 2011/0049201 | A1* | 3/2011 | Bertinotti | 223/112 |

FOREIGN PATENT DOCUMENTS

| | | | | | |
|---|---|---|---|---|---|
| GB | 633 930 | A | | 12/1949 | |
| GB | 2221604 | A | * | 2/1990 | A47G 25/82 |

OTHER PUBLICATIONS

PCT Written Opinion of the International Searching Authority for PCT Counterpart Application No. PCT/IB2007/004106, 6 pgs., (Jun. 13, 2008).

PCT Notification of Transmittal of the International Preliminary Report on Patentability for PCT Counterpart Application No. PCT/IB2007/004106, 11 pgs., (Apr. 3, 2009).

* cited by examiner

HOSIERY DONNING DEVICE, IN PARTICULAR FOR COMPRESSION HOSIERY

CROSS-REFERENCE TO RELATED APPLICATIONS

This patent application is a U.S. National Phase application under 35 U.S.C. §371 of International Application No. PCT/IB2007/004106, filed on Dec. 27, 2007, entitled HOSIERY DONNING DEVICE, IN PARTICULAR FOR COMPRESSION HOSIERY, which claims priority to Italian patent application number VB2006A000012, filed Dec. 28, 2006.

TECHNICAL FIELD

The present invention relates to a hosiery donning device, in particular for compression hosiery.

BACKGROUND ART

As is known, people who find it particularly difficult to bend down or move their legs, generally need the assistance of other people to put their socks or stockings on. Said need is particularly apparent in case of compression hosiery, in which a relatively strong force must be applied to stretch the elastic fabric outwards in order to insert the toes, make the sock or stocking slide over the leg and, above all, to pull the elastic fabric over the heel of the foot.

In an attempt to reduce or eliminate these difficulties, the known surgical products consist of a support over which the sock or stocking is placed and rolled-up before inserting the foot into said sock or stocking. Said support is maneuvered manually by means of a handle, which consists of an arm coupled via an articulated joint to a lower portion of the support. The support has a concave upper surface and is made to pass under the foot and past the heel by pulling the handle upwards, while the foot gradually enters the sock or stocking, passing over the support.

The solutions of the type described above fall short of being satisfactory, as it is difficult to pull and manoeuvre the handle to move the support past the heel towards the calf.

SUMMARY

The purpose of the present invention is to provide a hosiery donning device, in particular for compression hosiery, which overcomes the drawbacks described above in a simple and cost-effective manner.

According to the present invention a hosiery donning device is produced, in particular for compression hosiery.

BRIEF DESCRIPTION OF THE DRAWINGS

In order to better understand the present invention, a non-limiting preferred embodiment thereof will now be described by way of example with reference to the accompanying drawings, in which.

DETAILED DESCRIPTION

In the attached drawings, number 1 indicates a hosiery donning device. The term "hosiery" refers to men's socks, for example knee-length socks, women's socks and stockings, and compression stockings worn for medical reasons, with or without a toe portion and made of a fabric consisting of any type of material or with any degree of elasticity.

The device 1 is made of a semi-rigid or rigid material, in particular a plastic material (ABS, polyethylene, polypropylene, glass-nylon, polycarbonate) or a material derived from cereals (for example, a material marketed under the trade name of MATER-BI®). Advantageously, an ideal degree of rigidity/elasticity and an ideal degree of slipperiness on the outside surface of the device 1 are provided by a plastic nylon-based material containing approx. 20% by weight of glass fiber.

The device 1 is symmetrical in relation to a vertical median plane and comprises a base support 3 and an upper handle 4, which is fixed and faces upwards in relation to the support 3. The handle 4 and the support are preferably made in one-piece by injection moulding, in particular to obtain a device 1 with a constant thickness.

Figure 4:
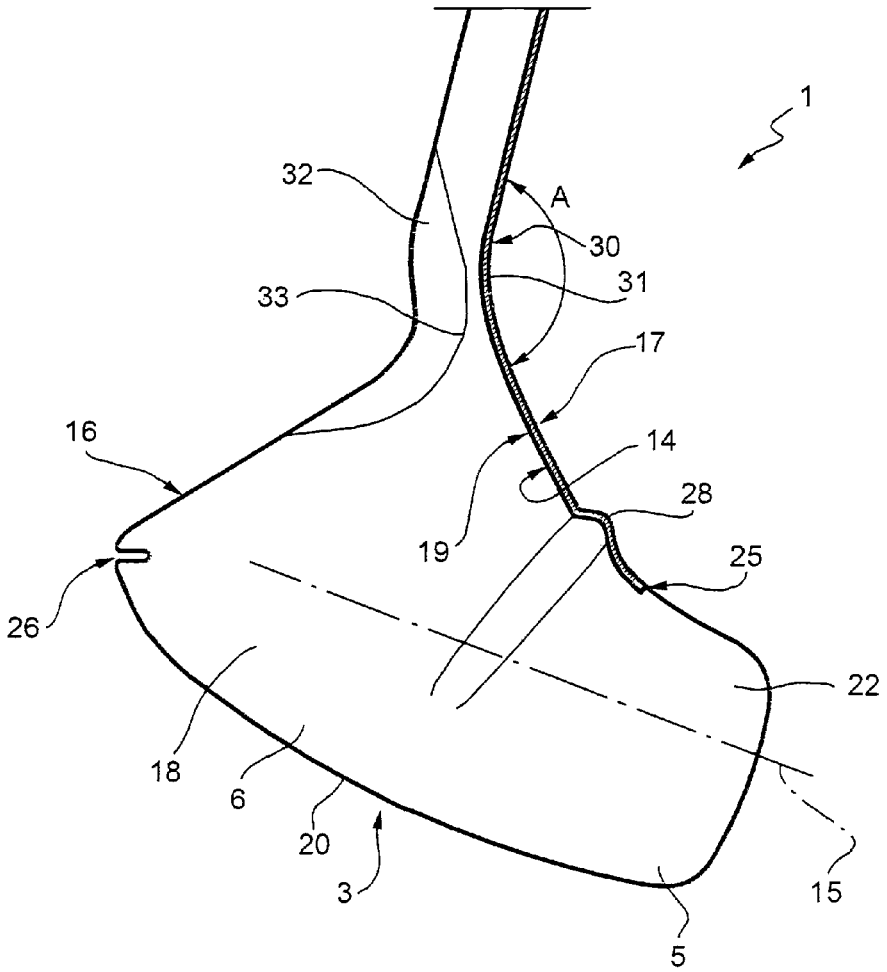
FIG. 4 is a cross-sectional view, on an enlarged scale, along the line IV-IV of FIG. 2.

The support 3 comprises a front end portion 5 and a saddle-shaped portion 6, which defines a downwards-facing cavity 14 (shown in FIG. 4). The cavity 14 (shown in FIG. 4) extends in a longitudinal direction 15 from the portion 5 up to a rear opening 16, beneath the handle 4.

The portion 6 has a convex upper outside surface 17, upon which, in use, at least a portion of the hosiery to be donned is gathered. The portion 6 comprises two side walls 18, which extend in a cantilevered fashion downwards in relation to an upper inside surface 19 of the cavity 14 (shown in FIG. 4) and have respective curved lower edges 20 with a downwardly-facing convexity. In particular, the device 1 has a center of gravity in a position such as to be balanced when standing on the floor resting on the edges 20.

The height of the walls 18, i.e. the vertical distance between the surface 19 and the edges 20, increases from the portion 5 towards the opening 16.

The portion 5 is appropriately shaped and, thanks to the type and thickness of the material that is used, it is elastically deformable, so that the support 3 can be inserted into the sock or stocking to be donned. The portion 5 comprises two flanges 22, which extend towards the front in a cantilevered fashion from the walls 18 of the portion 6, face one another, and are concave towards the inside of said cavity 14 (shown in FIG. 4). The edges of the flanges 22 have a rounded upper and lower corner, to facilitate the application of the hosiery, and between them superiorly define a recess 25, the profile of which in a plan view is essentially U-shaped.

The walls 18 have two notches 26, which are essentially obtained in correspondence with the opening 16 and are used to engage internally a top border of the hosiery.

Anteriorly, the portion 6 has a projection 28, which is arranged on the surface 17 in a position adjacent to the recess 25, it extends in an arch-like way, and is transversal in relation to the direction 15.

Posteriorly, the portion 6 is joined to the handle 4 by means of a fitting portion 30, which comprises a front area 31 and two side areas 32 or ribs, which define respective folds 33 in relation to the area 31 and to the walls 18. The folds 33 reinforce the portion 30 in case of anomalous stress or bending between the handle 4 and the support 3.

Figure 1:
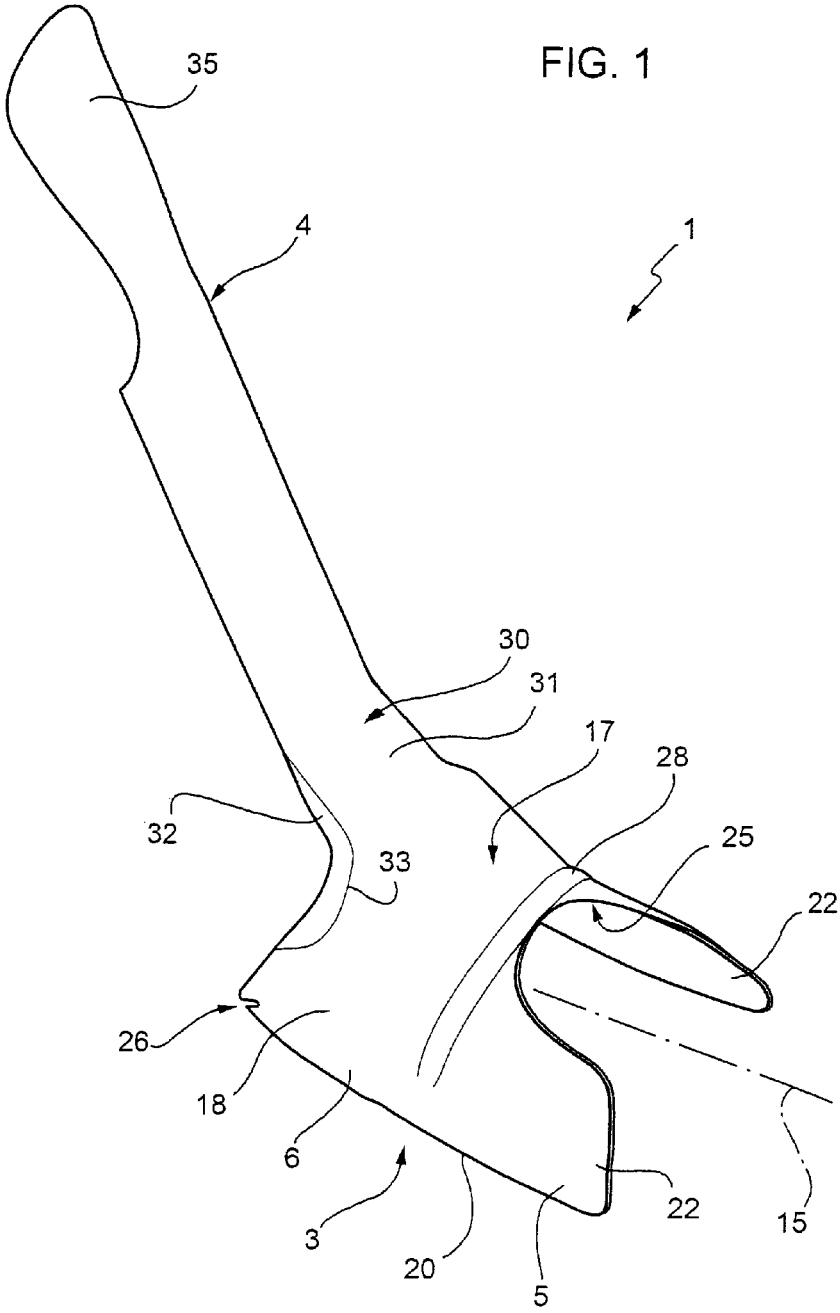
FIG. 1 is a perspective view of a preferred embodiment of the hosiery donning device, in particular for compression hosiery, according to the present invention.
Figure 2:
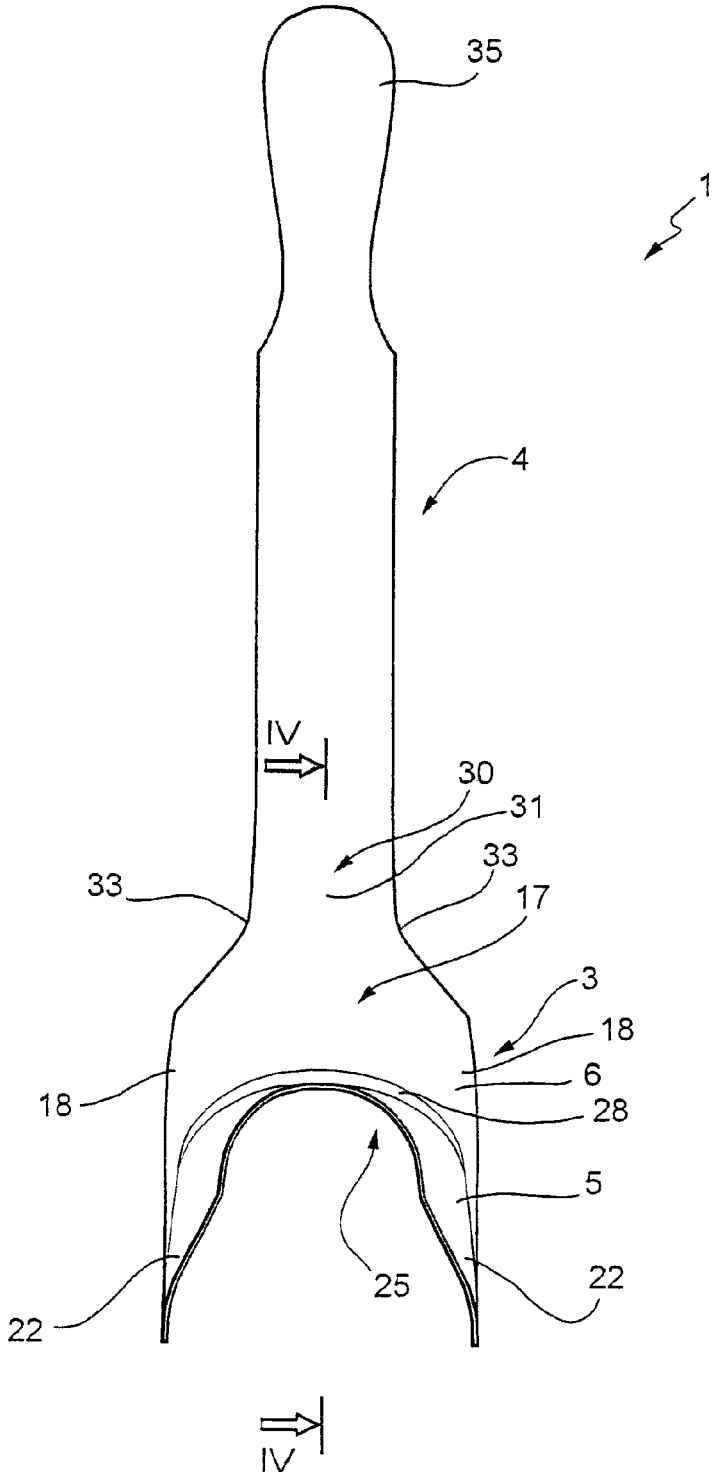
FIG. 2 is a front view of the device in FIG. 1.
Figure 3:
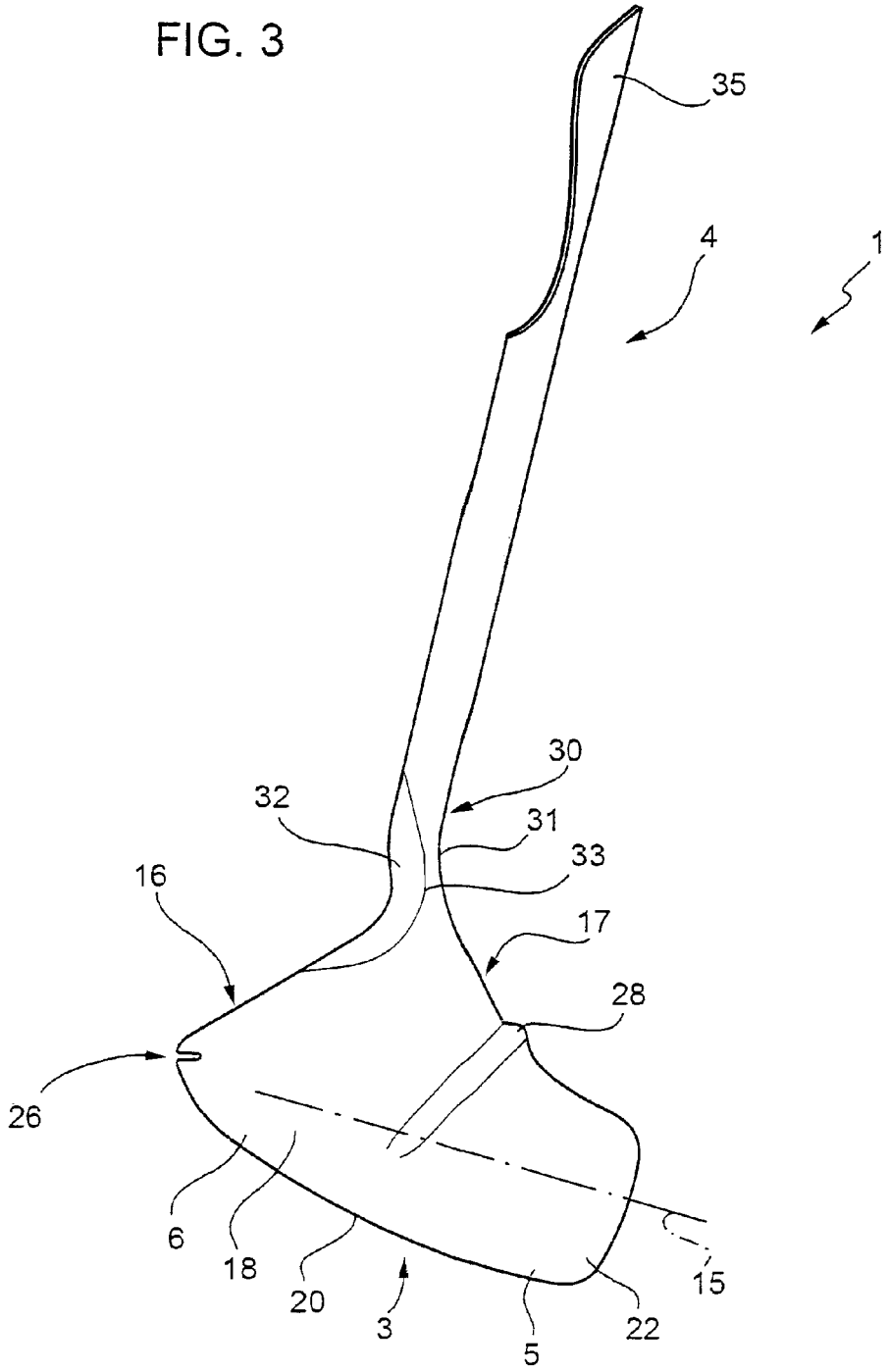
FIG. 3 is a side view of the device in FIG. 1.

To manoeuvre the support 3 from a distance, the handle 4 consists of an elongated rectilinear portion that is essentially at a right angle to the direction 15. As shown in the side view in FIG. 3 and in the cross-section in FIG. 4, the handle 4 is radiused via the area 31 to the upper profile of the portion 6, which is essentially rectilinear and forms an obtuse angle A with the handle 4. The angle A, in particular, is between 135° and 145°.

The handle 4 has an essentially semi-circular cross-section with the concavity facing towards the rear, so as to essentially fit against the user's leg.

The upper end of the handle 4 is indicated by reference number 35 and defines a shoehorn, which can also be used to remove the hosiery after use.

In use, the hosiery to be donned is placed around the support 3, gradually inserting the portion 5 into the hosiery in the direction 15 and gathering the hosiery on the portion 6 beyond the projection 28, until the portion 5 enters the toe portion of said hosiery. It is apparent that the projection 28 prevents the sock or stocking from slipping towards the portion 5, while it is being gathered around the portion 6. Meanwhile, the top border of the sock or stocking is pushed into the notches 26. In this way, said border is held in a fixed position exactly in correspondence with the rear opening 16.

To start donning the hosiery arranged around the portions 5 and 6, the foot is placed through the opening 16 and into the cavity 14 (shown in FIG. 4), while pulling the handle 4 of the device 1 parallel to the direction 15 towards the leg.

The foot is gradually inserted into the cavity 14 (shown in FIG. 4) in the direction 15, as the surface 19 is made to slide over the upper surface of the foot, until the tip of the foot pushes against the toe portion of the sock or stocking. This push causes the toe portion of the hosiery to slide off the portion 5 and settle against the tip of the foot.

The retaining force exerted by the notches 26 and, especially, by the projection 28, prevents the hosiery from coming off the support 3 all at once. In other words, as the tip of the foot pushes against the toe portion of the hosiery, the projection 28 allows the hosiery to slide off gradually.

When the support 3 reaches the instep of the foot, the shape of the surface 19 and of the connection defined by the portion 30 essentially matches the shape of the upper surface and instep of the foot. At this point, the handle 4 is tilted forwards manually leaving the surface 19 in contact with the instep of the foot and making the upper surface of the foot enter the recess 25, until the calf is aligned with the opening 16. In this way, the notches 26 and the walls 18 accompany the portion of the hosiery that closes the lower part of the cavity 14 (shown in FIG. 4) over the heel.

At this point the handle 4 is left in the forward tilted position and raised so as to continue pulling the sock or stocking over the calf. Finally, the notches 26 are freed so as to completely remove the support 3 from the end of the hosiery and from the leg.

From the above description it is apparent that the device 1 can even be used by people who have difficulty bending their backs or legs, enabling them to put their own hosiery on in a simple manner, regardless of the material out of which said hosiery is made.

The shoehorn function performed by the end of the handle makes the device 1 even more useful.

The fact that the device 1 is a one-piece construction makes it extremely simple to use and cheap to produce. The device 1 is particularly advantageous due to the total absence of any mechanisms, sharp edges, appendices or other accessories that could threaten the safety of the user and/or make the donning of hosiery more complicated.

Further advantages of the device 1 are apparent from the characteristics described above.

Lastly, it is clear that modifications and variations may be made to the device 1 described and illustrated herein without departing from the scope of the present invention, as set forth in the appended claims.

In particular, the handle could be a separate part attached to the support 3, and possibly detachable from the support 3. Furthermore, depending on the size and height of the user, the parts of the device 1 could have different proportions to those illustrated herein.

What is claimed is:

1. Hosiery donning device comprising:

a support comprising:

a) a front end portion that can be inserted into a hosiery to be donned, and b) a saddle-shaped portion to hold at least a portion of a fabric of said hosiery, having a convex upper outside surface, and defining a cavity, into which a foot is placed, in use, to don the hosiery; said cavity facing downwards to allow said support, in use, to slide over the upper surface and instep of said foot;

c) a handle facing upwards in relation to said support;

a connecting portion to connect said handle to said support at the end opposite to said front end portion in a relative fixed position;

wherein:

said saddle-shaped portion is able to hold a gathered portion of the hosiery upon said convex upper outside surface;

said front end portion comprises two side flanges, which extend towards the front in a cantilevered manner from said saddle-shaped portion, face one another, and have respective upper edges defining a central recess; said central recess extending longitudinally into said front end portion, from a front edge of said front end portion towards said convex upper outside surface of said saddle-shaped portion, and having a U-shaped profile in a plan view; in use, said recess being adapted to be engaged by the upper surface of the foot when said handle is tilted forwards, with said saddle-shaped portion in contact with the instep of the foot, wherein the upper profile of said saddle-shaped portion is essentially rectilinear and forms, with said handle, an obtuse angle, which is between 135° and 145°.

2. The hosiery donning device according to claim 1, wherein said saddle-shaped portion comprises two side walls, which extend downwards in a cantilevered manner and, in use, accompany a portion of the hosiery over the heel of the foot when said handle is tilted forwards, with said saddle-shaped portion in contact with the instep of the foot; said side walls having curved lower edges with a downwardly-facing convexity.

3. The hosiery donning device according to claim 2, wherein the device has a center of gravity in a position such as to be balanced when standing on the floor resting on said curved lower edges.

4. The hosiery donning device according to claim 1, wherein said flanges are concave towards the inside of said cavity; the edge of said flanges having, respectively, a rounded upper and lower corner.

5. The hosiery donning device according to claim 1, further comprising at least one notch on an edge of said saddle-shaped portion to hold the at least portion of the fabric of said hosiery; said notch being located at said cavity.

6. The hosiery donning device according to claim 1, wherein said connecting portion, and handle and said support are a one-piece construction.

7. The hosiery donning device according claim 6, wherein said connecting portion is a concaved portion having two reinforcement side folds.

8. The hosiery donning device according to claim 1, further comprising at least one projection to hold the at least portion of the fabric of said hosiery, wherein the projection is located in a position adjacent to said recess and extends in an arch-like manner on said upper outside surface.

9. The hosiery donning device according to claim 1, wherein at least said front end portion is elastically deformable.

10. The hosiery donning device according to claim 1, wherein the device is made of a nylon-based plastic material with the addition of glass fiber.

11. The hosiery donning device according to claim 1, wherein the device is made of a material derived from cereals.

12. The hosiery donning device according to claim 1, wherein said central recess provides an opening in a vertical direction so as to define a slot between said upper edges.

13. The hosiery donning device according to claim 1, wherein the upper outside surface is made of a plastic nylon-based material containing twenty percent by weight of glass fiber.

14. The hosiery donning device according to claim 1, wherein the hosiery donning device has a constant thickness.

15. The hosiery donning device according to claim 1, wherein the handle has a semi-circular cross-section with a concavity adapted to face towards a leg of a user.

* * * * *